United States Patent [19]

Sprute

[11] Patent Number: 4,681,262

[45] Date of Patent: Jul. 21, 1987

[54] CAP CONNECTING PROPELLANT CONTAINER WITH MATERIAL CONTAINER

[75] Inventor: Fritz A. Sprute, Chagrin Falls, Ohio

[73] Assignee: The Sherwin-Williams Company, Cleveland, Ohio

[21] Appl. No.: 781,067

[22] Filed: Sep. 27, 1985

[51] Int. Cl.[4] ..... B05B 7/30

[52] U.S. Cl. ..... 239/306; 239/346

[58] Field of Search ..... 239/346, 304, 308, 426, 239/434, 340, 306; 222/182.5; 220/23.4

[56] References Cited

U.S. PATENT DOCUMENTS

| | | | |
|---|---|---|---|
| 3,044,713 | 7/1962 | Ellis | 239/308 |
| 3,058,669 | 10/1962 | Drell | 239/304 |
| 3,162,370 | 12/1964 | Moonan et al. | 239/304 |
| 3,224,645 | 12/1965 | Frost | 222/182 |
| 3,225,958 | 12/1965 | Frankenberg | 222/182 |
| 3,591,088 | 7/1971 | Green | 239/304 |

*Primary Examiner*—Andres Kashnikow
*Assistant Examiner*—Kevin Patrick Weldon
*Attorney, Agent, or Firm*—Robert E. McDonald; James V. Tura; David B. Deioma

[57] ABSTRACT

A spray head for use with a liquid to be sprayed and a propellant. The spray head includes a first cap which has segmented, arcuate, resilient, annular gripping sections having outwardly extending projections which grip an annular lip on the container of propellant. A cover on the first cap is shaped and adapted to coact with a dome on the first container so that a section of the spray head is placed under compression or tension by opposing forces when the spray head is attempted to be removed from the container of the propellant. A second cap has a body with threads to connect it to a second container which would normally contain a liquid. A bridge included in the second cap is operatively attached to the first cap. The bridge includes a channel through it and has ne end connecting an opening in the first cap. An actuator on the bridge controls a spring-biased valve n the propellant container. The other end of the channel and bridge is in close proximity to a bore in the second cap. Orifices in the channel and bore have sizes and relative positions so that pressurized fluid passing through the channel orifice will draw liquid out of the second container.

13 Claims, 5 Drawing Figures

FIG. 1
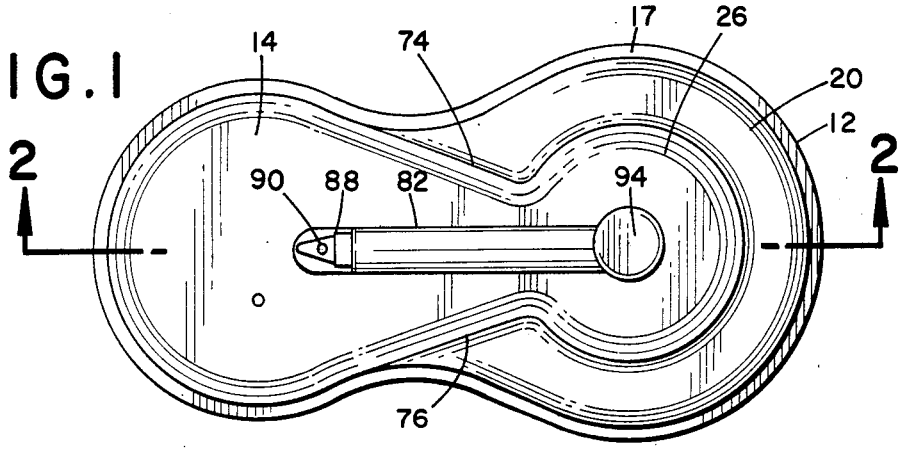
FIG. 2
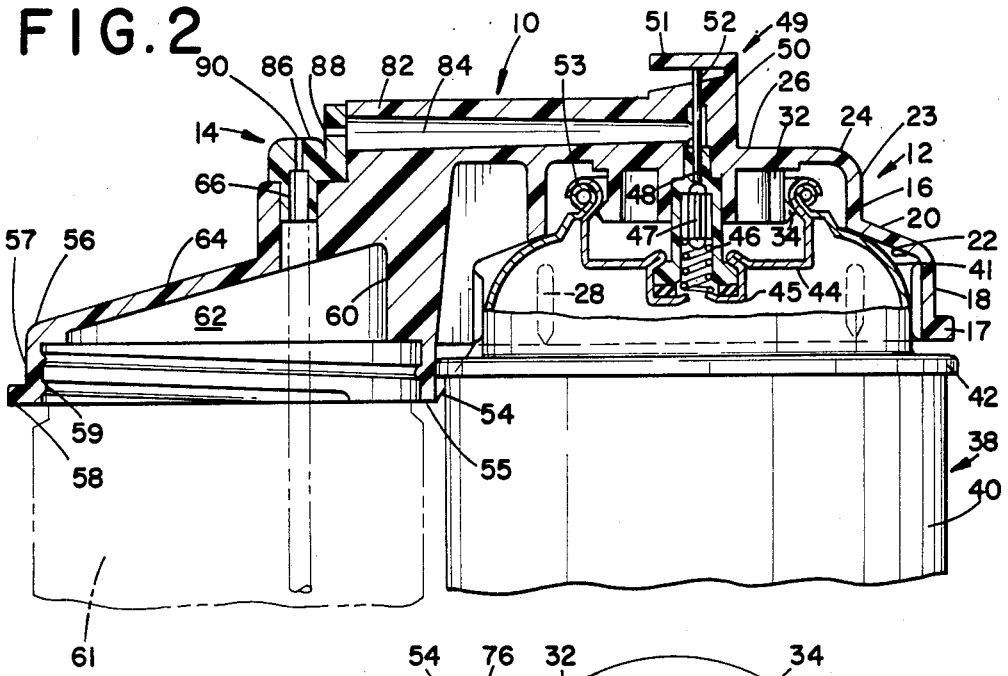
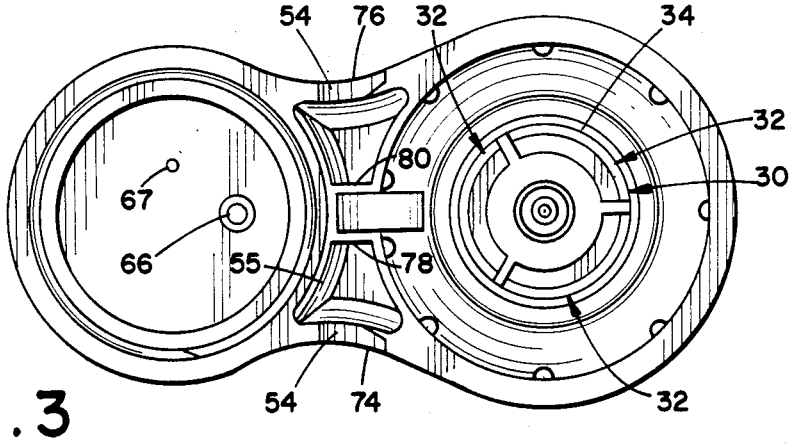
FIG. 3

CAP CONNECTING PROPELLANT CONTAINER WITH MATERIAL CONTAINER

BACKGROUND OF THE INVENTION

This invention relates to a spray device for dispensing liquid products such as paint. It uses a pressurized propellant passing through a spray head to draw a liquid out of its non-pressurized container and atomize it.

Paints have commonly been marketed in single aerosol containers with a volatile propellant. These spray containers permit a uniform application of paint for relatively small jobs where one color is required. Repainting of appliances such as refrigerators, washers and dryers are typical applications where a single aerosol container is useful.

There are many applications, however, where only a small quantity of paint of any given color is required. Examples of such uses are touch-ups to automobile or truck surfaces. The small quantity of the required paint for such applications makes the use of aerosol containers containing the propellant and the paint cost-prohibitive. Such aerosol containers normally include the container, a non-reusable aerosol head, paint propellant and all of the labor and capital costs to assemble it. Largely as a result of the appurtenant costs of a single aerosol container, alternate designs have evolved. In one alternate, the propellant and the paint are held in separate containers and connected by a detachable spray head. In this way, small quantities of paint of different colors may be used with a single container of propellant. Many other liquids, such as lubricants and cosmetics, can also be sprayed with such a device. The discussion relative to paints should be understood to apply to any liquid.

Because of the very nature of detachable containers and a spray head, there are some particularly desirable characteristics. Ideally, a spray head should be readily attachable and detachable to both containers. However, the spray head attachment means should have a mechanism which does not accidentally detach from the containers in use and functions with a standard aerosol can. Prior devices have had some of these desirable characteristics, but have had some shortcomings.

U.S. Pat. No. 3,044,713, which is hereby incorporated by reference, shows one type of spray head. It includes a first section which attaches to a standard aerosol can, a second section which is threaded to a liquid container, and a bridge connecting the two sections. The first section fits over a dome at the top of the aerosol container and generally conforms to its shape. While the disclosed spray head functions reasonably well, it is susceptible to accidental detachment from the aerosol container. In particular, if the paint container were pressed against the aerosol can, the first section of the head would partially dislodge from its correct location on the dome. The misalignment of the spray head with its actuator from the aerosol container will cause a malfunction.

U.S. Pat. No. 3,162,370 to Moonan et al., the disclosure of which is hereby incorporated by reference, also shows a spray head connecting an aerosol can with a container of liquid. The spray head has a first section which fits over the dome of the aerosol can and a small cylindrical portion that fits over the valve stem. Because of the spray head's direct contact with the valve stem, they are susceptible to damage from each other if they are not aligned and attached correctly. Moreover, the spray head does not grip the aerosol can and, accordingly, it may be accidentally misaligned or dislodged.

SUMMARY OF THE INVENTION

The present invention has substantial advantages over prior devices. It includes a spray head that is readily attachable and detachable from a standard aerosol container, but when in place strongly resists accidental misalignment or detachment. This invention automatically aligns the spray head and aerosol container as they are connected and holds them in alignment during use. In particular, the spray device of this invention includes a spray head, a first container and a second container. The first container is a generally cylindrical aerosol can having a dome at one end thereof. A receiving means including an inwardly projecting annular lip is part of the dome and coacts with the spray head. The spray head has a first cap with gripping means that include resilient annular ring sections which engage the receiving means. The first cap portion of the spray head generally conforms to and fits over the dome. A shoulder portion of the first cap optionally extends between the first and second containers at a location where the dome is attached to the body of the first container. Top portions of the first cap and the gripping means thereon interact in such a manner that part of the first cap is put under tension or compression by opposing forces if the spray head is rotated relative to an axis transverse to the aerosol container. The resistance of the spray head to compressive forces tends to hold it in place and in alignment on the dome of the aerosol container, thus prohibiting the vast majority of accidental disassemblies or misalignments.

BRIEF DESCRIPTION OF THE DRAWINGS

FIG. 1 is a top view of the spray head of this invention;

FIG. 2 is a cross-sectional view of the spray head attached to containers of this invention;

FIG. 3 is a bottom view of the spray head of this invention;

DETAILED DESCRIPTION OF THE DRAWINGS

Figure 4:
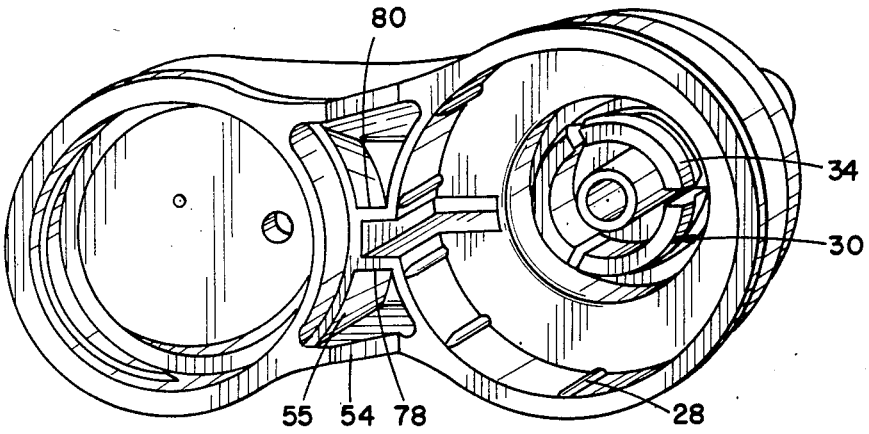
FIG. 4 is a bottom perspective view of the spray head of this invention.

As illustrated in FIGS. 1 through 5, but particularly in FIG. 2, this invention includes a spray head 10, a first cap 12, and a second cap 14. The first cap 12 includes a cover 16 having an annular flange 17 at the bottom of the cylindrical wall 18. Radially inwardly tapering conical section 20 merges into a cylindrical portion 23 forming a rounded corner 24 with a top transverse wall 26. Ribs 28 act to reinforce the cylindrical wall 18.

As seen in FIGS. 2, 3, and 4, a means 30 for gripping a container 38 is part of the first cap and includes annular sections 32. They are formed of downwardly projecting, radial arcs, although other shapes may be utilized. At the bottommost portions of the annular sections 32 are outwardly extending radial projections 34. It is anticipated that other types of gripping means may be utilized with this invention which interact and hold the cap in place on a container and strongly resist accidental misalignment or detachment from the spray head.

Figure 5:
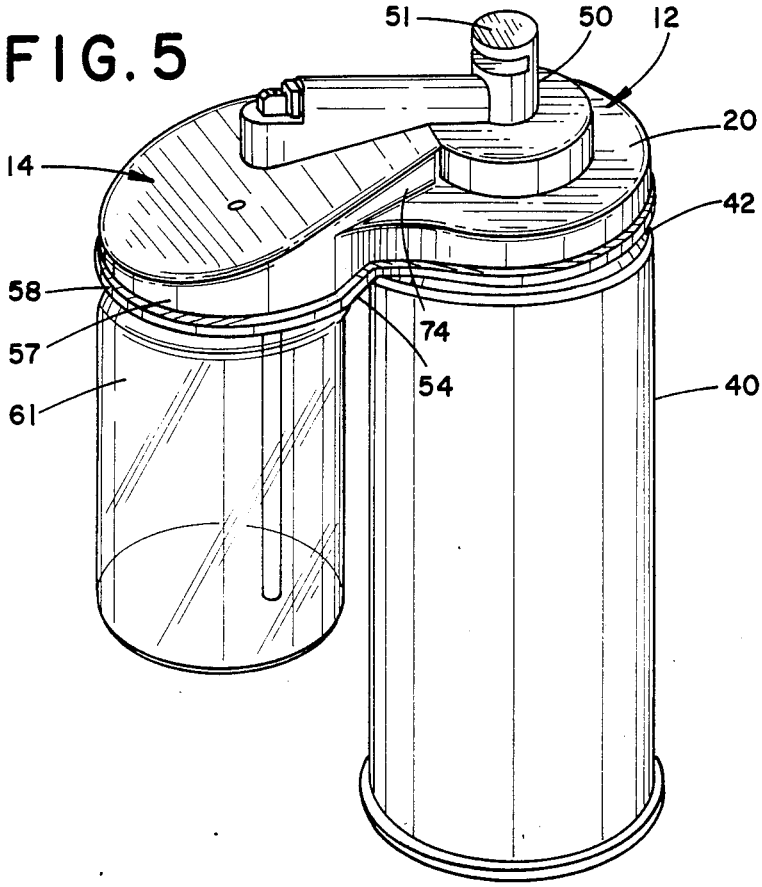
FIG. 5 is a perspective view of the spray head and container of this invention.

The first cap 12 interacts with the first container 38 in FIGS. 2 and 5. The preferred first container 38 is a commercially available model having a body 40 and a dome 41 above and connected thereto by means of a rolled seam 42. The dome 41 includes a top 44 which has a recess 45 supporting a spring member 46 pushing a small fluted piston 47 upwardly. One end of an opening 48 is sealed by the piston 47 in its upwardmost position.

The first cap further includes an actuator 49 which may be of various designs, but in this particular instance includes a head 50, a button 51 connected thereto, and a pin 52 actuated by the button and cooperatively in contact with the piston 47.

An annular rolled seam 53 connects parts of the dome and interacts with the gripping means 30. There is a recess below the annular seam 53 to accommodate the radial projection 34 on the annular sections 32. The annular seam 53 and the recess therebelow acts to form a receiving means for the gripping means. It is anticipated that other complementary shapes may act as a receiving means.

A second cap 14 is operatively attached to the first cap 12 by means of a bridge 15 which forms part of the second cap. The second cap further includes a shoulder 54 and a cylindrical portion 55. A cylindrical wall 57, an annular flange 58 on the outside thereof, and internal threads 59 are also part of the second cap. An internal wall 60 forms part of a cavity 62 which is further formed by an upwardly angled top wall 64 having an air hole 67. A bore 66 in the second cap forms an opening for fluid to pass through a tube, illustrated in phantom, from the second container 61 to the atmosphere.

The bridge 15 includes a first structural wall 74 and a second structural wall 76 which converge inwardly from the second container toward the first container. Internal walls 78 and 80 act as supports and spacers between the cylindrical portions of the first cap and the second cap. A channel wall 82 forms the outside of a bore 84 connecting the opening in the first cap with a bore in the second cap. An orifice 88 at the end of the bore 84 is spaced a distance away from an orifice 90 at the end of a bore in the second cap in order to interact with it. The sizes and spacings of the orifices are well known in the art.

In operation, a pressurized liquid turns into a gas when the pressure on it is reduced. Thus, when the button 51 is depressed, the pin 52 moves the piston 47 away from its seal, thus permitting gas to pass between the flutes of the piston 47, through the opening in the first cap, and through the bore 84. In passing through the bore 84, a low pressure draws unpressurized fluid, normally a liquid and often paints, perfumes and other chemicals, from the second container 61 into the atmosphere.

The attaching and detaching operations of the spray head and the first container are important. In general, the first container 38 is placed in operation with the first cap by pressing the two together. As they are pressed together, the radial projections 34 on the gripping means 30 move against the annular seam 53 forming part of the receiving means. The natural resiliency of the annular sections, which are usually made of plastic, allow them to be cammed radially inwardly, until they pass into the slight recess below the annular seam 53. In doing so, the radial projections 34 engage some of the lower portion of the annular ring, thus locking it in position. In this position, the pin 52 comes into engagement with the piston 47.

The second container 61 is simply threaded into position on the second cap 14, although they could be connected in the same manner as the first cap and container. When both containers are in position, they are separated by the shoulder 54 and a portion of the cylindrical wall 55. The shoulder 54, cylindrical wall 55, and gripping means 30 interact in a novel manner whereby substantially more force is required to separate them than in the prior art. In particular, it is estimated that at least two to fifteen times the force required in the prior art is necessary to separate the first cap from the first container by pushing downwardly on the second cap and two to ten times the force is needed when pulling up. This unexpected result occurs because the shoulder 54, cylindrical wall 55, and annular sections 32 are designed to create directionally opposing forces in such a situation. Such forces act to place part of the first cap between the shoulder and gripping means in compression or tension. However, when the spraying operation is completed and it is desired to remove the first container from the first cap, it is only necessary to grasp the second cap and pull upwardly relative to the first container 38. In this direction, the cylindrical wall 18 acts in conjunction with the gripping means to permit the parts to be separated with substantially less force. In all cases, jarring or dropping of the assembly, or unwarranted forces on the cap, do not normally disengage the means for gripping. Moreover, the natural resiliency of the gripping means acts to automatically realign the first cap with the first container from slight jarring. That is, the resiliency of the annular sections 32 will force the annular ring 53 on the container 38 back into position above the radial projections 34. Thus, the substantial benefit of eliminating the vast majority of accidental detachments or misalignments which cause malfunctions between the spray head and the container has been realized without adding an elaborate connecting means. Also, it is important to note that the container 38 is a standard version having standard size domes, so that no particular parts are required.

While the invention has been shown and described with respect to a particular embodiment thereof, this is for the purpose of illustration rather than limitation, and other variations and modifications of the specific embodiment herein shown and described will be apparent to those skilled in the art all within the intended spirit and scope of the invention. Accordingly, the patent is not to be limited in scope and effect to the specific embodiment therein shown and described nor in any other way that is inconsistent with the extent to which the progress in the art has been advanced by the invention.

What is claimed is:

1. A spray device comprising an aerosol container adapted to hold the pressurized propellant, the aerosol container having a body and a dome at one end of the body and a receiving means on the dome;

the receiving means including an annular inwardly projecting annular lip and a recess therebelow, an opening in the dome whereby fluid may pass from the aerosol container and a spring-biased valve in the dome of the aerosol container;

a spray head adapted for use with the aerosol container including a first cap adapted to interfit with a portion of the dome including means for gripping the receiving means, the means for gripping including generally arcuately shaped resilient sections dimensioned so that they cam against and engage the annular lip of the receiving means when the cap is placed on the aerosol container; and a second cap including a bridge portion operatively connected to the first cap, the bridge including a channel therein connecting the opening in the first cap with a bore in the second cap whereby the means for gripping on the first cap interacts with the second cap to place a portion there between in compression or tension when a force is exerted on the spray head which attempts to rotate it relative to the longitudinal axis of the container, the resistance of the cap to the compression or tension causing it to hold it against substantial forces from being misaligned or removed from the aerosol container.

2. A spray head adapted for use with a propellant in a first container and a liquid to be sprayed in a second container, one of the containers having a dome including a receiving means at one end of a body for coacting with the spray head, comprising:

a first cap adapted to interfit with a portion of the dome and the receiving means, the first cap including means for gripping the receiving means, a cover included in the first cap adapted to fit over and coact with the dome on the container;

an opening in the first cap through which gas may pass from one of the containers, an actuator operatively connected to the first cap;

a second cap having a means for connecting it to another container, the second cap having a bore therethrough;

the second cap including a bridge portion operatively connected to the first cap, the bridge including a channel therein connecting the opening in the first cap with the bore in the second cap, the means for gripping including a plurality of segmented, resilient, downwardly and outwardly projecting projections, the receiving means including an annular lip which is gripped by the projections, the means for gripping on the first cap interacting with the annular lip on the receiving means and the second cap to place a section of the second cap therebetween under compression or tension by opposing forces when the spray head is attempted to be removed from the receiving means, and thereby holding the spray head firmly in position; and orifices at one end of the channel and the bore having sizes and relative positions so that pressurized fluid passing through the channel orifice will draw liquid through the bore in the second cap.

3. The spray head of claim 2, wherein the means for gripping includes resiliently mounted generally radially projecting flanges which cam against the receiving means on the dome.

4. The spray head of claim 3, wherein the second cap has a shoulder which extends downwardly near a portion where the dome connects with the body of the first container and abuts against it when a force is exerted on the second cap.

5. The spray head of claim 3, wherein the the second cap has a cylindrical portion near a portion where the dome connects with the body of the container and abuts against it when a force is exerted on the second cap, thus holding the spray head in place.

6. The spray head of claim 2, wherein the dome on the first container has an opening through which an upwardly biased, spring-biased valve stem passes;

the dome further including a radially inwardly directed lip with a recess below, the means for gripping including segmented, arcuate, resilient annular sections having radially outwardly projecting projections which are so dimensioned that they cam against and grip the lip on the dome.

7. The spray head of claim 6, wherein the first cap includes a head, the head including a button-type actuator which acts to open the spring-biased valve in the first container.

8. The spray head of claim 7, wherein the second cap has a cavity above the means for connecting it to the second container.

9. A spray device comprising:

an aerosol container adapted to hold a pressurized propellant, the aerosol container having a body including a receiving means;

a second container adapted to hold a liquid to be sprayed including means for attaching the second container to a spray head;

a spray head including a first cap adapted to interfit with the receiving means, the first cap including means for gripping the receiving means and a cover included in the first cap adapted to fit over and coact with part of the aerosol container, an opening in the first cap through which gas may pass from the aerosol container and an actuator operatively connected to the first cap;

a second cap having a body with means for connecting it to the second container, the second cap having a bore therethrough;

the second cap including a bridge portion operatively connected to the first cap, the bridge including a channel therein connecting the opening in the first cap with the bore in the second cap, the bore and channel being of sizes and relative positions whereby pressurized fluid passing through the channel orifice will draw liquid throughout the bore in the second cap and out of the second container, the means for gripping including a plurality of segmented, resilient, downwardly and outwardly projecting projections, the receiving means including an annular lip which is gripped by the projections, the means for gripping on the first cap interacting with the annular lip and the receiving means and the second cap to place a section of the second cap therebetween under compression or tension by opposing forces when the spray head is attempted to be removed from the receiving means, thereby holding the spray head firmly in position.

10. The spray device of claim 9, wherein the receiving means is a generally annular lip on the aerosol container, the means for gripping are arcuately shaped projections having an annular ring thereon which engages the annular lip, and the second cap includes a cylindrical portion near a portion where the dome connects with the body of the container which abuts against it when a force is exerted on the second cap, thus holding the spray head in place.

11. The spray device of claim 10, wherein the first container has a dome at one end including the receiving means and the second cap includes a cover having a shoulder extending along the dome to a portion where the dome connects with the body of the aerosol container, thus separating the aerosol container and the second container, and the shoulder abuts against both of them when a force is exerted downwardly on the second cap.

12. The spray device of claim 11, wherein the first cap includes a head operatively attached thereto having a button-type actuator and acts to open a spring-biased valve in the aerosol container.

13. The spray device of claim 12, wherein the dome on the aerosol container has an opening through which an upwardly biased spring-biased valve stem passes and the dome on the aerosol container further includes a radially inwardly directed lip with a recess below.

* * * * *